United States Patent [19]

Watanabe et al.

[11] Patent Number: 4,457,321

[45] **Date of Patent: * Jul. 3, 1984**

[54] COIN HANDLING APPARATUS

[75] Inventors: Kenkichi Watanabe; Katusuke Furuya; Toyoki Kimoto, All of Tokyo, Japan

[73] Assignee: Laurel Bank Machine Co., Ltd., Tokyo, Japan

[ * ] Notice: The portion of the term of this patent subsequent to Jan. 25, 2000 has been disclaimed.

[21] Appl. No.: 248,028

[22] Filed: Mar. 26, 1981

[30] Foreign Application Priority Data

Mar. 28, 1980 [JP] Japan ..... 55-39880

[51] Int. Cl.[3] ..... G07D 9/04

[52] U.S. Cl. ..... 133/8 A; 221/21

[58] Field of Search ..... 133/1 A, 3 D, 4 A, 8 R, 133/8 A; 221/21

[56] References Cited

U.S. PATENT DOCUMENTS

| | | | |
|---|---|---|---|
| 3,687,255 | 8/1972 | Johnson | 194/1 N |
| 3,754,558 | 8/1973 | Conant et al. | 221/21 X |
| 4,088,144 | 5/1978 | Zimmermann | 133/8 E |
| 4,216,788 | 8/1980 | Watanabe et al. | 133/8 R |
| 4,369,800 | 1/1983 | Watanabe et al. | 133/8 R |

*Primary Examiner*—F. J. Bartuska

*Attorney, Agent, or Firm*—Fleit, Jacobson, Cohn & Price

[57] ABSTRACT

Herein disclosed is a coin handling apparatus such as a coin packaging apparatus which is free from any trouble that would be caused when the power supply service is interrupted or when the power supply circuit is carelessly broken. The coin handling apparatus includes a rotary solenoid which can rotate back and forth at a predetermined angle thereby to control the opening and closing operations of the guide passage by a rotary pin. Further inclusive is a power source detecting circuit which is made operative to detect the existence of the power supply to the coin handling apparatus thereby to generate output signals respectively corresponding to the existence and nonexistence of the power supply. A drive circuit is further included and made responsive to the output signals of the power source detecting circuit thereby to drive the rotary solenoid so that the rotary pin may open the guide passage in response to the output signal corresponding to the existence of the power supply, until the number of the coins conveyed to a coin accumulating cylinder reaches a predetermined value, and may close the guide passage in response to the output signal corresponding to the nonexistence of the power supply.

9 Claims, 4 Drawing Figures

COIN HANDLING APPARATUS

BACKGROUND OF THE INVENTION

1. Field of the Invention

The present invention relates to a coin handling apparatus which is free from any trouble that would be caused when the power supply service is interrupted or when the power supply circuit is carelessly broken.

2. Description of the Prior Art

In case the power supply circuit of a coin handling apparatus such as a coin packaging apparatus according to the prior art is broken, while it is operating, by the cause of a service interruption, its coin selecting means and conveying means are allowed to run for a while by the inertia, although its coin counting means has lost the coin detecting and counting functions, so that the coins on the selecting means are still fed through the guide passage to the coin accumulating cylinder. As a result, there arises a trouble that a discrepancy is raised between the number of the coins, which are already passed through the coin counting means of the guide passage when the power supply circuit is made again, and the number of the coins, which is indicated by the indicating counter to express the coins having been counted before the counting means has lost its counting function.

SUMMARY OF THE INVENTION

It is, therefore, an object of the present invention to provide a coin handling apparatus which is free from the disadvantage of the prior art.

Another but major object of the present invention is to provide a coin handling apparatus which is enabled to block the passage of coins by the use of a simple mechanism even in case the power supply service is interrupted or in case the power supply circuit is carelessly broken.

According to a feature of the present invention, there is provided a coin handling apparatus including: selecting means for selecting a predetermined kind of coins from the remaining coins; a guide passage disposed adjacent to said selecting means for guiding the selected coins therethrough; conveyor means for conveying said selected coins on said guide passage; counting means disposed midway of said guide passage for counting the number of the coins being conveyed; means disposed downstream of said guide passage for accumulating the coins having been conveyed thereto; and blocking means disposed in said guide passage just downstream of said counting means for normally opening said guide passage and for closing said guide passage, when the number of the coins having been conveyed to said accumulating means reaches a predetermined value, thereby to block the succeeding coins, wherein the improvement comprises: passage control means for controlling the opening and closing operations of said blocking means; a power source detecting circuit for detecting the existence of the power supply to said coin handling apparatus thereby to generate output signals respectively corresponding to the existence and nonexistence of said power supply; and a drive circuit made responsive to the output signals of said power source detecting circuit to drive said passage control means so that said blocking means may open said guide passage in response to the output signal corresponding to the existence of said power supply, until said predetermined value is reached, and may close said guide passage in response to the output signal corresponding to the nonexistence of said power supply.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

The present invention will now be described in connection with one embodiment thereof with reference to the accompanying drawings.

Figure 1:
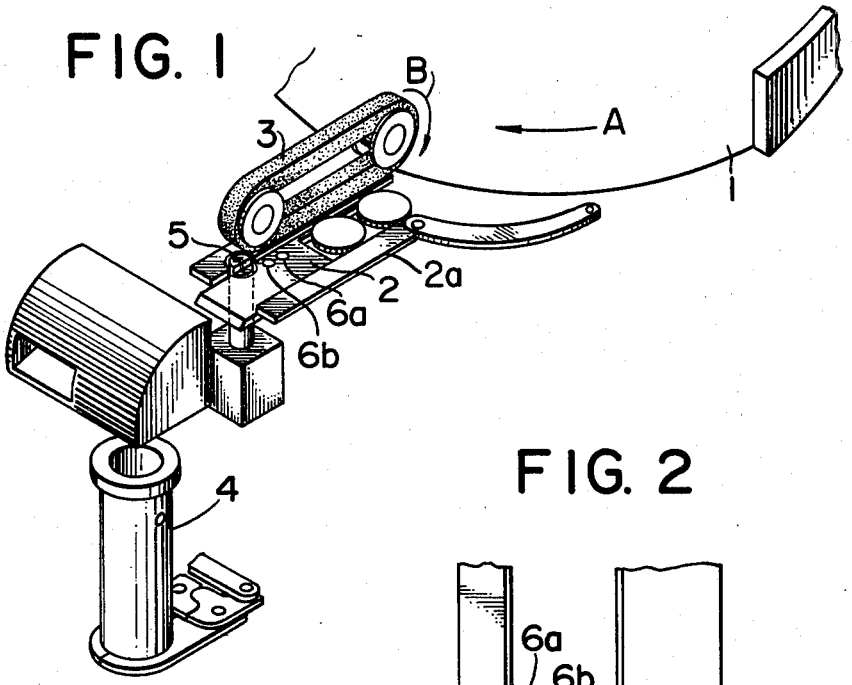
FIG. 1 is a perspective view showing a coin packaging apparatus exemplifying the coin handling apparatus according to the present invention.

In the coin packaging apparatus, as shown in FIG.1, a predetermined kind of coins are consecutively introduced from a rotary disc 1, which is rotating in the direction of arrow A, onto a guide passage 2 and are conveyed by a conveyor belt 3, which is made to run in the direction of arrow B, until they are accumulated or stacked in a coin accumulating cylinder 4. The predetermined kind of coins are selected by conventional selecting means 2*a*, such as a movable guide plate of the type described in U.S. Pat. No. 4,216,788. In this case, the guide passage 2 is equipped with both a rotary pin 5 for opening and closing the passage 2 and a pair of photosensors 6*a* and 6*b* for counting the number of the coins being conveyed on the passage 2. When the number of the coins stacked in the coin accumulating cylinder 4 reaches a predetermined value, the rotary pin 5 is rotationally driven by a drive mechanism such as a rotary solenoid thereby to interrupt the introduction of the coins into the coin piling cylinder 4. Incidentally, the coin counting circuit is usually fed with an electric power continuously even when the power supply circuit is broken. However, elements having high power consumptions such as the photosensors or electromagnetic solenoids are not backed up by the preliminary power source such as a battery.

Figure 2:
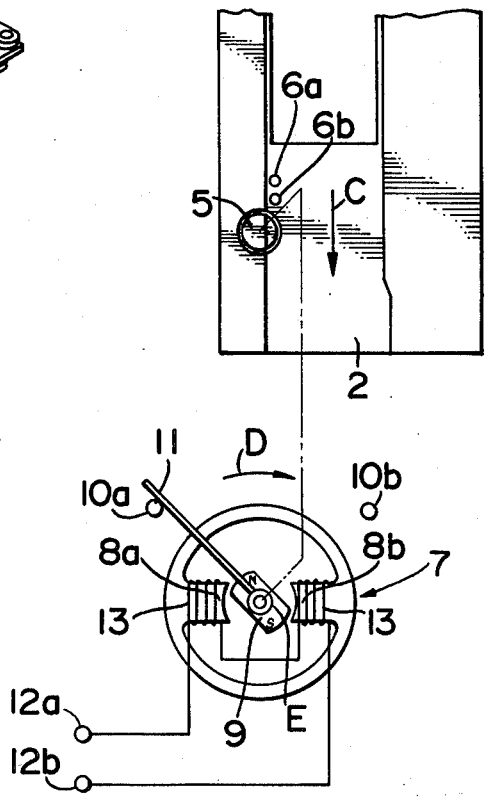
FIG. 2 is an exploded top plan view showing the construction of an essential portion of the present invention.

Turning now to FIG. 2 showing the essential portion of the present invention, the parts corresponding to those appearing in FIG. 1 are indicated with identical reference numerals. Numeral 2 appearing in FIG. 2 indicates the guide passage, into which the coins are introduced from the rotary disc 1 shown in FIG. 1 so that they are conveyed in the direction of arrow C. The rotary pin for blocking the passage of the coins is so arranged in one side wall of the guide passage 2 that it can rotate at a predetermined angle. The photo sensors 6*a* and 6*b* for counting the number of the coins being conveyed are arranged just upstream of the rotary pin 5.

This rotary pin 5 is connected to the shaft of rotation of a rotary solenoid 7 by connecting means, not shown, so that it can rotate back and forth. The rotary solenoid 7 is provided with a pair of protrusions 8*a* and 8*b*, which protrude inwardly from the diametrical opposite portions of a core having a cylindrical shape, for example, in a manner to face each other, a polarized magnet, which is interposed between those protrusions 8a and 8b such that it can rotate on an axis E, an arm 11, which is fixed to that magnet so that it can swing between a pair of stoppers 10a and 10b, and a pair of coils which are wound upon the aforementioned protrusions 8a and 8b thereby to swing the aforementioned arm 11 between the stoppers 10a and 10b in response to the polarities of the pulses fed between a pair of input terminals 12a and 12b.

In the rotary solenoid 7 thus constructed, moreover, in case an electric current is fed in the direction from the input terminal 12b to the input terminal 12a, an N polarity is established on the inner circumference of the protrusion 8a whereas an S polarity is established on the inner circumference of the other protrusion 8b. Since, moreover, the protrusions 8a and 8b and the magnet 9 have their identical polarities facing each other, repulsive forces are generated inbetween so that the arm 11 is swung in the direction of arrow D from the position of the stopper 10a until it reaches the other stopper 10b. Here, since the magnet 9 will tend to maintain a more stable magnetic path even if no current is fed between the input terminals 12a and 12b, the arm 11 is held at the position of the stopper 11b. In the drive mechanism for driving the rotary pin 5 with the use of the rotary solenoid 7, more specifically, the arm 11 is swung between the stoppers 10a and 10b in accordance with the polarities of the pulses to be fed between the input terminals 12a and 12b, and these swinging motions are transmitted by the connecting means, not shown, to the rotary pin 5, whereby the coins are conveyed and stopped.

Figure 3:
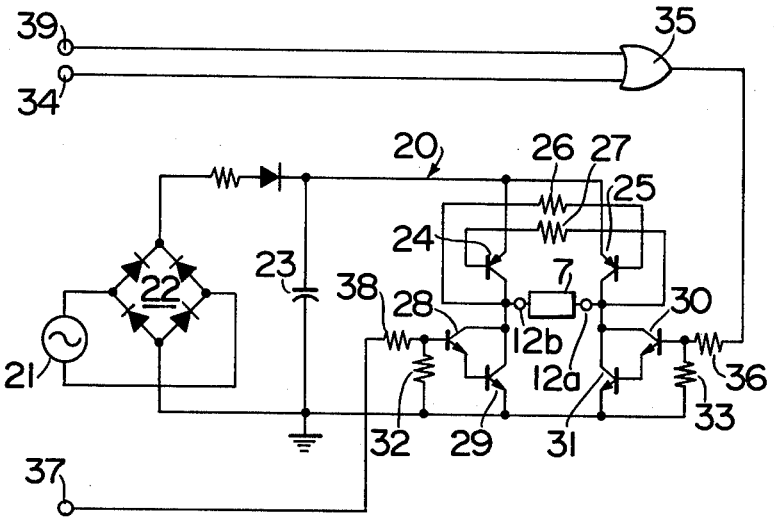
FIGS. 3 and 4 are circuit diagrams showing the drive circuit and the power source detecting circuit to be incorporated into the coin packaging apparatus according to the present invention.

FIG. 3 shows one example of a drive circuit 20 for driving the aforementioned rotary solenoid 7. The drive circuit 20 is composed of, as shown, a diode bridge 22 and a condenser 23, which are made coactive with each other to rectify and smoothen the a.c. current of a power source 21, a pair of transistors 24 and 25, which have their common emitter connected with the positive terminal of the power source 21, a resistor 26, which is connected between the base of the transistor 25 and the collector of the transistor 24, a resistor 27, which is connected between the base of the transistor 24 and the collector of the transistor 25, four transistors 28, 29, 30 and 31 of Darlington connection, which have their respective collectors connected with the respective collectors of those transistors 24 and 25, and a pair of resistors 32 and 33 which are connected between the respective bases of those transistors 28 and 30 and the negative terminal of the power source 21. Moreover, the rotary solenoid 7 shown in FIG. 2 has its input terminal 12a connected with the collector of the transistor 31 and its input terminal 12b connected with the collector of the transistor 29.

Thus, in case an OR gate 35 is fed through an input terminal 34 with a "1" signal of a binary logic level, its "1" signal is fed through a resistor 36 to the base of the transistor 30 so that the transistors 30 and 31 are rendered conductive. As a result, the current to flow through the rotary solenoid 7 is consecutively fed from the collector of the transistor 24 through the input terminals 12b and 12a to the collectors of the transistors 30 and 31.

As a result, the arm 11 is swung in the direction of the arrow D, as has been described hereinbefore, so that the unnotched solid head of the rotary pin 5 is brought into the guide passage 2 thereby to block the passage of the coins.

On the other hand, in case a count starting signal (i.e., the "1" signal) is fed from an input terminal 37 through a resistor 38 to the base of the transistor 28, the current to flow through the rotary solenoid 7 is consecutively fed from the collector of the transistor 25 through the input terminals 12a and 12b to the collectors of the transistors 28 and 29. As a result, the arm 11 is swung in the opposite direction to that of the arrow D (as viewed in FIG. 2) so that the notched head of the rotary pin 5 is brought to face the guide passage 2 thereby to allow the passage of the coins. Incidentally, the condenser 23 is stored with such a charge as is sufficient to make the aforementioned drive circuit 20 drive the rotary solenoid 7 thereby to rotate the rotary pin 5 in case the power supply circuit is broken. Moreover, a terminal 39, which is connected with the input terminal of the OR gate 35, is to be fed with a count terminating signal.

Figure 4:
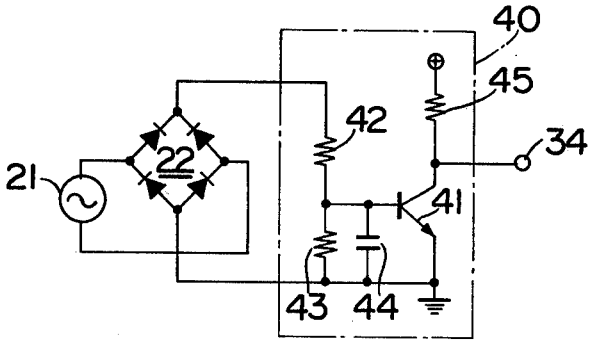

FIG. 4 shows an example of a power source detecting circuit 40 which is to be connected with the input terminal 34. The parts corresponding to those appearing in FIG. 3 are indicated with identical reference numerals in FIG. 4. Numeral 41 appearing in FIG. 4 indicates a transistor which has its base fed through a resistor 42 with such a pulsating current which has been prepared by rectifying the full wave of the power source 21. A resistor 43 and a condenser 44 are respectively connected between the base and emitter of the transistor 41. This transistor 41 has its collector connected through a pull-up resistor 45 with the power source, which is backed up by a battery, and further with the aforementioned input terminal 34. Thus, the power source detecting circuit 40 thus constructed feeds a "0" signal and a "1" signal out of the input terminal 34 in case the power source 21 effects its power supply or not, respectively. Incidentally, the resistor 43 is used to accelerate the discharge of the condenser 44 when the power source 21 effects no power supply, whereas the condenser 44 is used to smoothen the pulsating current, which is fed when the power source 21 effects its power supply, to such an extent that the transistor 41 is not rendered conductive and inconductive.

The operations of the constructions thus far described will be described in the following.

First of all, when the input terminal 37 is fed with the count starting signal (i.e., the "1" signal), the rotary pin 5 is rotated as a result of the swinging motion of the arm 11 of the rotary solenoid 7, as shown in FIG. 2, so that the coins on the rotary disc 1 are conveyed through the guide passage 2 into the coin accumulating cylinder 4 by the action of the conveyor belt 3. In this case, the number of the coins is counted in accordance with the outputs of the photo sensors 6a and 6b.

When the coins are counted up to a predetermined value, a count end signal (i.e. the "1" signal) is issued to be fed on the terminal 39. As a result, the "1" signal is fed to the drive circuit through the OR gate 35, and thereby driving the rotary solenoid so that the arm 11 is swung in the direction of the arrow D. Thus, the unnotched solid head of the rotary pin 5 is brought into the guide passage 2 to close the passage 3 so that the subsequent coins are blocked.

In case the power supply circuit of the power source 21 is broken during the aforementioned operation by reason of a service interruption or the like, the "1" signal is instantly fed from the power source detecting circuit 40 through the input terminal 34 to the OR gate 35. As a result, in a similar manner as described above, the drive circuit 20 drives the rotary solenoid 7 so that the arm 11 is swung in the direction of the arrow D until it takes the condition of FIG. 2. As a result, the unnotched solid head of the rotary pin 5 is brought into the guide passage 2 to close the passage 2 so that the subsequent coins, which might otherwise be conveyed toward the coin piling cylinder 4 by the inertia of the rotary disc 1 and the conveyor belt 3, are blocked. After that, the rotary solenoid 7 holds the rotary pin 5 at the aforementioned closing position even if the drive circuit 20 is deenergized to fail to drive the rotary solenoid 7.

As has been described hereinbefore, according to the present invention, it is possible to prevent the coins from being further conveyed as soon as the power supply service is interrupted and to prevent the number of the coins from being miscounted.

What is claimed is:

1. A coin handling apparatus including: selecting means for selecting a predetermined kind of coins from a plurality of coins; a guide passage disposed adjacent to said selecting means for guiding the selected coins therethrough; conveyor means for conveying said selected coins on said guide passage; counting means disposed for counting the number of the coins being conveyed through said guide passage; means disposed downstream of said guide passage for accumulating the coins having been conveyed thereto; and blocking means disposed in said guide passage downstream of said counting means for normally opening said guide passage and for closing said guide passage, when the number of the coins having been conveyed to said accumulating means reaches a predeteremined value; thereby to block the succeeding coins, wherein the improvement comprises: passage control means for controlling the opening and closing operations of said blocking means; a power source detecting circuit for detecting the existence of the power supply to said coin handling apparatus thereby to generate output signals respectively corresponding to the existence and nonexistence of said power supply; and a drive circuit responsive to the output signals of said power source detecting circuit to drive said passage control means so that said blocking means opens said guide passage in response to the output signal corresponding to the existence of said power supply, until said predetermined value is reached, and closes said guide passage in response to the output signal corresponding to the nonexistence of said power supply, said blocking means including a rotary pin having a notched portion and positioned in one of the side walls of said guide passage such that it rotates at a predetermined angle to open said guide passage, when said notched portion coextends with the inner side of the corresponding side wall of said guide passage, and closes said guide passage when said notched portion protrudes at said predetermined angle into said guide passage.

2. A coin handling apparatus according to claim 1, wherein said passage control means includes a rotary solenoid made rotatable back and forth at said predetermined angle.

3. A coin handling apparatus according to claim 2, wherein said rotary solenoid includes a shaft connected to said rotary pin, a cylindrical core enclosing said shaft, a pair of protrusions protruding inwardly from the diametrically opposite portions of said cylindrical core in a manner to face each other, a polarized magnet supported on said shaft and made rotatable therewith to and from said protrusions, an arm fixed to said polarized magnet, a pair of stoppers spaced angularly around said shaft for determining the angular stroke of the swings of said arm and accordingly said predetermined angle of said rotary pin through said polarized magnet and said shaft, a pair of input terminals made receptive of pulses, and a pair of coils respectively wound on said protrusions and connected with said input terminals for swinging said arm between said stoppers in response to the polarities of the pulses fed through said input terminals.

4. A coin handling apparatus according to claim 3, wherein said drive circuit includes a diode bridge and a condenser made coactive with each other for rectifying and smoothing the a.c. current of said power supply, first and second transistors having their common emitter connected with the positive terminal of said power supply, a resistor connected between the base of the first-named transistor and the colletor of the second-named transistor, a resistor connected between the base of the second-named transistor and the collector of the first-named transistor, third, fourth, fifth and sixth transistors of Darlington connection having their respective collectors connected with the collectors of the first- and second-named transistors, and a pair of resistors connected between the respective bases of said third- and fifth-named transistors, said fourth- and sixth-named transistors having their collectors respectively connected with the input terminals of said rotary solenoid.

5. A coin handling apparatus according to claim 3, wherein said power source detecting circuit includes a resistor, a seventh transistor having its base fed through said resistor with the pulsating current which is prepared by rectifying the full wave of said power supply, a resistor and a condenser connected between the base and emitter of the seventh-named transistor, and a pull-up resistor connected between the collector of the seventh-named transistor and said power supply.

6. A coin handling apparatus according to claim 1, wherein said conveying means includes a conveyor belt spaced above said guide passage and extending along said guide passage for engaging with the selected coins thereby to convey the same to said counting means.

7. A coin handling apparatus according to claim 1, wherein said counting means includes a pair of photosensors arranged tandem in the bottom of said guide passage for optically counting the number of the coins being conveyed.

8. A coin handling apparatus according to claim 1, wherein said accumulating means includes a coin stacking cylinder positioned upright for stacking the predetermined number of the coins into a package.

9. A control apparatus for controlling the passage of coins through a guide passage of a coin handling apparatus, said control apparatus comprising:

blocking means movable between a blocking position preventing passage of coins through said guide passage and a non-blocking position permitting passage of coins through said guide passage, said blocking means including a rotary pin having a notched portion and positioned in one of the side walls of said guide passage such that it rotates at a predetermined angle to open said guide passage, when said notched portion coextends with the inner side of the corresponding side wall of said guide passage, and closes said guide passage when said notched portion protrudes at said predetermined angle into said guide passage;

passage control means for controlling movement of said rotary pin between the blocking and non-blocking positions thereof;

power source detecting means for sensing the nonexistence of power from a power source supplying power to the coin handling apparatus and for generating an output signal upon the sensing of the nonexistence of power; and a drive circuit responsive to said output signal for driving said passage control means to move said rotary pin into the blocking position thereof.

* * * * *